US006223771B1

(12) United States Patent
Brown

(10) Patent No.: US 6,223,771 B1
(45) Date of Patent: May 1, 2001

(54) OVERFILL PREVENTION DEVICE FOR LIQUEFIED GAS TANKS

(76) Inventor: J. B. Brown, 5659 E. Hightower Trail, Social Circle, GA (US) 30025

( * ) Notice: Subject to any disclaimer, the term of this patent is extended or adjusted under 35 U.S.C. 154(b) by 0 days.

(21) Appl. No.: 09/442,160

(22) Filed: Nov. 16, 1999

Related U.S. Application Data

(60) Provisional application No. 60/111,091, filed on Nov. 24, 1998.

(51) Int. Cl.[7] ..... E03B 11/00

(52) U.S. Cl. ..... 137/574; 62/50.2; 141/18; 141/95; 141/198

(58) Field of Search ..... 137/574; 141/95, 141/18, 198; 62/50.2

(56) References Cited

U.S. PATENT DOCUMENTS 2,140,559 * 12/1938 Scully et al. ..... 141/95 X
3,684,127 * 8/1972 Kruse, Jr. ..... 141/95 X
5,829,491 * 11/1998 Bennett ..... 141/95 X

* cited by examiner

*Primary Examiner*—John Rivell
(74) *Attorney, Agent, or Firm*—Todd Deveau; Ryan A. Schneider; Troutman Sanders LLP

(57) ABSTRACT

The present invention is a liquefied gas tank having a sealing partition positioned internally at approximately the eighty percent (80%) liquid volume level as measured from the bottom of the tank, and thus creating an approximately twenty percent (20%) vapor space in the upper portion of the tank. Carried by the partition is an excess flow valve positioned generally perpendicular to the partition in an upward direction such that any flow through the valve will be released into the approximately twenty percent (20%) vapor space. Attached to the top of the tank is a fill valve that allows the inputting and outputting of liquefied and vapor gases. A fill tube extends from the fill valve through the partition and into the liquid space wherein liquefied gas is pumped into the liquid space of the tank. When the liquid space is filled, the excess flow valve will open thereby allowing approximately 1 gal/min to flow into the vapor space. At the same time, the lower excess flow rate as compared to the fill rate will create a back pressure at the fill source thus indicating to the operator that the tank is adequately filled.

8 Claims, 1 Drawing Sheet

OVERFILL PREVENTION DEVICE FOR LIQUEFIED GAS TANKS

This Appln claims the benefit of Provisional No. 60/111,091, filed Nov. 24, 1998.

TECHNICAL FIELD

The present invention relates generally to safety devices for gas tanks and, more specifically, to an overfill prevention device for liquefied gas tanks.

BACKGROUND ART

Liquefied gas tanks generally are used to store liquefied petroleum gases such as propane, propylene, butanes and butylenes for use in a plurality of applications including cooking, heating, drying and liquefied petroleum gas fueled engines. More than 18 billion gallons of liquefied petroleum gas are consumed each year in the United States alone. Since these highly flammable gases/liquids are under pressure in liquefied gas tanks, and since an enormous number of liquefied gas tanks are sold every year for use in both industrial and residential applications, there is an essential need for a design of these tanks that reduces the risk of bodily injury caused by tank overfill.

Storage tanks are typically filled to approximately 80–85% of the liquid capacity to allow for the expansion of liquefied petroleum gases and thus proper operation. Regulations and safety requirements have been implemented requiring that liquefied petroleum gas tanks not be filled to 100% capacity but preferably limited to approximately 80% capacity. As a result, a multitude of designs have been proposed to ensure compliance with these requirements. Many of the designs use a float-type system with a flapper portion, similar to a toilet flapper, that acts to close the fill input line when the volume in the tank reaches a specified amount. However, this type of design is disadvantageous, as flapper float mechanisms frequently get dislodged or hung, thereby resulting in an unreliable and less accurate means for preventing the overfilling of liquefied gas tanks.

It is readily apparent that a new and improved overfill prevention device for liquefied gas tanks is needed that is reliable, cost effective and under compliance with the user's local regulations and safety requirements. It is to the provision of such an improvement that the present invention is primarily directed.

BRIEF SUMMARY OF THE INVENTION

Briefly described, in a preferred embodiment, the present invention overcomes the above-mentioned disadvantages by providing a liquefied gas tank having a sealing partition positioned internally at less than one hundred percent (100%) and preferably, but not necessarily, at approximately the eighty percent (80%) of its liquid volume level as measured from the bottom of the tank. The sealing partition thus creates a vapor space in the upper portion of the tank of preferably, but not necessarily, approximately twenty percent (20%) of the liquid volume of the tank. An excess flow valve is positioned generally perpendicular to the partition in an upward direction such that any flow through the excess valve will be released into the vapor space of the tank. Attached to the top of the tank is a fill valve, preferably a multi-function valve, well known within the art, that allows input and output of liquefied and vapor gases. A fill tube extends from the fill valve through the partition and into the liquid space wherein liquefied gas is pumped into the liquid space of the tank.

In a preferred embodiment, the excess flow valve is rated at approximately one gallon per minute (1 gal/min), while the fill rate for the tank is greater than 1 gal/min, generally 3–4 gal/min. As such, when the liquid space is filled, the excess flow valve will open thereby allowing approximately 1 gal/min to flow into the vapor space. At the same time, the lower excess flow rate as compared to the fill rate will create a back pressure at the fill source and a stress on the fill source pump. The stress on the fill source pump will ordinarily cause an audible checking noise from the pump, thus indicating to the operator that the tank is adequately filled. In an alternate embodiment, a gauge may be added at the multi-function valve to indicate a back pressure and thus that the tank is filled to the desired liquid volume of less than 100%. In another embodiment, a pressure relief valve is carried by the partition and is generally vertical to allow pressure to be released from the liquid space to ensure that unsafe or unnecessary pressure does not buildup in the liquid space.

A feature and advantage of the present invention is to provide a new and improved liquefied gas tank that indicates to the user that the tank is filled to the desired liquid volume of less than 100% of the tank, preferably approximately 80% of its liquid volume capacity.

Another feature and advantage of the present invention is to provide a new and improved liquefied gas tank that incorporates an excess flow valve having a flow rate lower than the fill rate, thus creating a back pressure at the fill source when the tank is adequately filled.

Another feature and advantage of the present invention is to provide a new and improved liquefied gas tank having a sealing partition positioned internally at less than 100% of the liquid volume of the tank, preferably approximately 80% of its volume as measured from the bottom of the tank upward.

Another feature and advantage of the present invention is to provide a new and improved liquefied gas tank having a pressure relief valve positioned on a partition to allow pressure to be transferred from the lower partitioned area to the upper partition area.

These and other objects, features and advantages of the invention will become more apparent to one skilled in the art from the following description and claims when read in light of the accompanying drawings.

DETAILED DESCRIPTION OF THE PREFERRED EMBODIMENT

Figure 1:
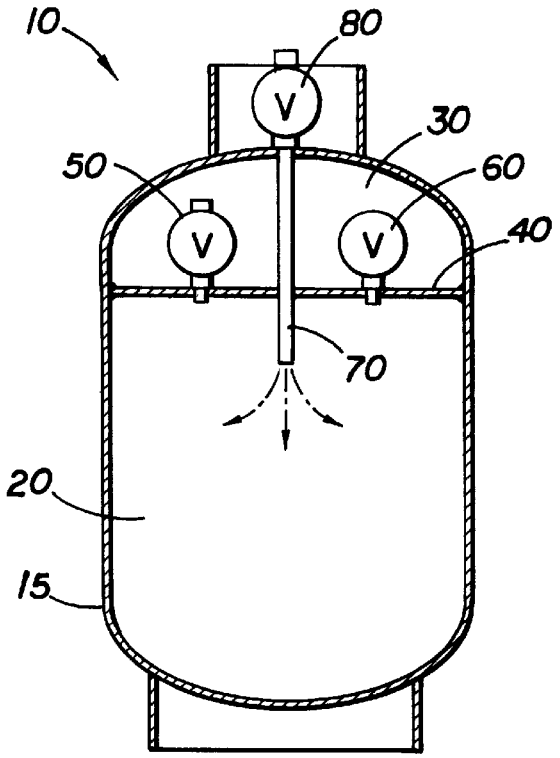
FIG. 1 is a cutaway side view of the present invention according to a preferred embodiment.

Referring now in detail to the drawing figures wherein like references represent like parts throughout, FIG. 1 illustrates device 10 generally comprising tank body 15, partition 40, excess flow valve 50, fill tube 70, and multi-function valve assembly 80.

Tank body 15 can be any one of the many well known tanks conforming, preferably, to Department of Transportation (DOT) specifications and other local regulations. Hermetically sealed within tank body 15 is partition 40. Partition 40 is horizontally positioned within tank body 15 such that less than 100% of the tank body's liquid fill capacity, and preferably approximately 80% of tank body's 15 capacity, is below partition 40. Partition 40 defines vapor space 30 located above partition 40, and liquid space 20 located below partition 40, all within tank body 15.

Attached to and extending through partition 40 is excess flow valve 50. Excess flow valve 50 is positioned in the upward direction such that when liquid space 20 is over full of liquefied gas, the liquefied gas can flow upward into vapor space 30. Also extending through partition 40 is fill tube 70. The proximal end of fill tube 70 is attached to a multi-function valve 80, well known in the art, carried by tank body 15. The distal end of fill tube 70 extends through partition 40 and into liquid space 20, thereby allowing the input liquefied gas to be pumped directly into liquid space 20.

The flow rate at which gas can flow through excess flow valve 50 is preselected to be less than the rate at which the liquefied gas is inserted into liquid space 20. Preferably, the flow rate allowed by excess flow valve 50 is approximately 1–2 gallons per minute, but may vary as long as its flow rate is significantly lower than the input flow rate into the tank. The differential in flow rates between excess flow valve 50 and input flow will result in a back pressure at the input source (i.e., pump) when liquid space 20 is full and excess liquefied gas begins to flow through excess flow valve 50. This back pressure will indicate to the user that the tank has reached the desired liquid fill capacity as defined by the location of partition 40, via an audible check of the source pump.

In an alternate embodiment, the present invention further includes a pressure relief valve 60 attached to and extends through partition 40. Pressure relief valve 60 is selected to open and relieve pressure from liquid space 20 into vapor space 30 at a pressure below that required by DOT or other local regulations for fill valves.

It should also be noted that the flow rate through excess flow valve 50 can be increased or decreased depending on the input fill rate as long as the flow rate through excess flow valve 50 is sufficiently below the fill rate so as to create a back pressure when liquid space 20 is full. In lieu of multi-function valve assembly 80, two separate valves may be utilized, one for fill/servicing and one for outflow/applications. In addition, partition 40 may be placed at various locations within tank body 15 to achieve a desired fill capacity of less than 100% of the liquid fill volume of the tank, or in order to comply with any local regulations.

Figure 2:
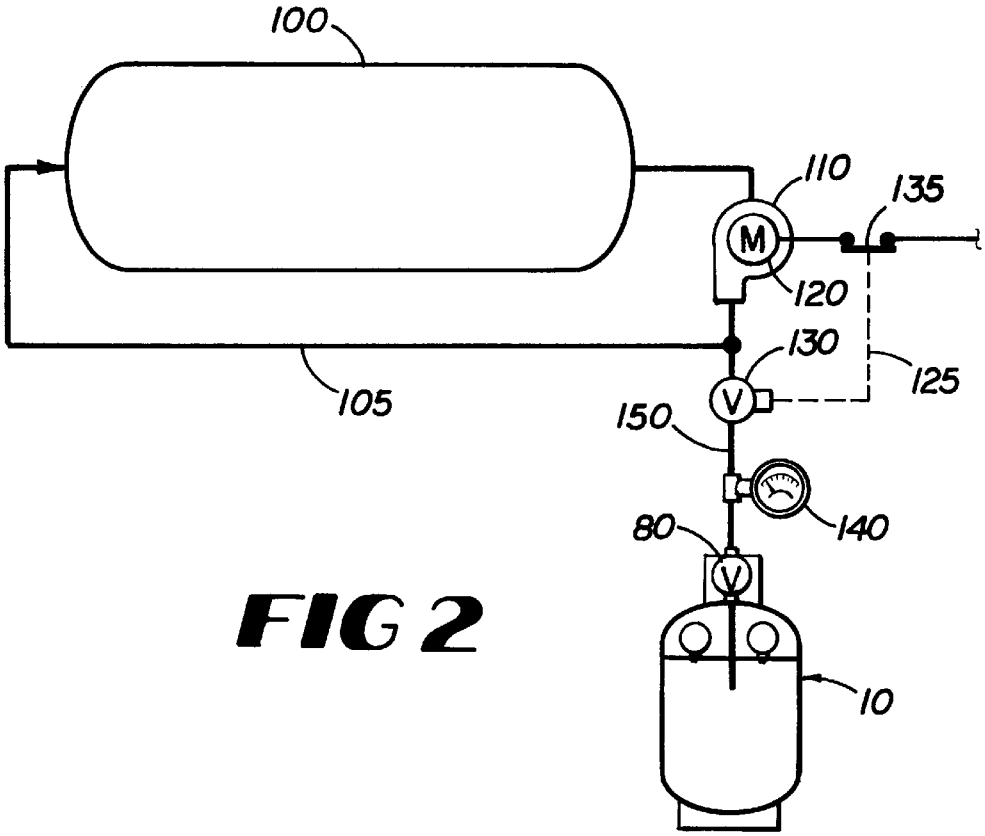
FIG. 2 illustrates an optional automatic by-pass valve and shut-off fill system for use in conjunction with the present invention.

In another alternative embodiment, a gauge may be placed in line with the fill source to assist the user in determining when a back pressure exists and thus liquid space 20 is full. Additionally, a switch may be added to monitor back pressure and automatically shutoff the fill source. This optional arrangement is illustrated by FIG. 2. There is shown fill source 100, pump bypass line 105, fill source pump 110, fill source pump motor 120, motor cutoff loop 125, pressure regulated valve 130, pump trigger switch 135, pressure gauge 140 and fill line 150. When liquid space 20 is full and back pressure is created, pressure gauge 140 will indicate a pressure change. In addition, pressure regulated valve 130 will close, thereby tripping pump trigger switch 135 that sends a signal via motor cutoff loop 125 to shut down source pump motor 120. Pump bypass line 105 allows any residual flow resulting from the delay in the closing of pressure regulated valve 130 and the shutting down of fill source pump motor 120 to divert to fill source 100.

While the invention has been disclosed in its preferred forms, it will be apparent to those skilled in the art that many modifications, additions, and deletions can be made therein without departing from the spirit and scope of the invention and its equivalents as set forth in the following claims.

What is claimed is:

1. An overfill prevention device for a liquefied gas tank having a tank volume and a multi-function valve assembly, the valve assembly enabling the tank to be filled with gas at a gas input flow rate, the overfill prevention device comprising:

a) a partition within the liquefied gas tank, said partition defining an upper vapor space and a lower liquid space within the tank, said partition hermetically sealing said upper vapor space from said lower liquid space;

b) a fill tube having a distal end and a proximal end, the fill tube extending through said partition, the distal end positioned in said lower liquid space, the proximal end in communication with the multi-function valve assembly; and c) an excess flow valve carried by said partition, said excess flow valve enabling therethrough an excess flow rate of gas;

the tank capable of being filled with gas at the input flow rate through the multi-function valve assembly and said fill tube, the gas entering said lower liquid space of the tank through said fill tube; and gas from said lower liquid space being capable of flowing through said excess flow valve at the excess flow rate to said upper vapor space when said lower liquid space is full of gas, the excess flow rate being less than the input flow rate.

2. The device of claim 1, wherein the volume of said lower liquid space is approximately eighty percent of the tank volume.

3. The device of claim 1, wherein gas through said excess flow valve provides a back pressure counter the gas input flow rate, the device further comprising stopping means carried by the liquefied gas tank for automatically stopping the flow of gas into the tank upon detection of the back pressure.

4. The device of claim 1, further comprising a pressure relief valve carried by said partition wherein said pressure relief valve is capable of relieving pressure from said lower liquid space into said upper vapor space.

5. An overfill prevention device for a liquefied gas tank, the tank having a tank body with a top and a bottom, the tank body hermetically sealed to form a chamber, the tank further having a fill valve carried by the top of the tank body for the input of liquefied gas, the liquefied gas being input into the chamber through the fill valve at an input flow rate, the device comprising:

a) a partition, wherein said partition is hermetically sealed within the chamber of the tank body, said partition defining an upper vapor space and a lower liquid space within the chamber of the tank body;

b) an excess flow valve carried by said partition, said excess flow valve enabling therethrough an excess flow rate, wherein liquefied gas from said lower liquid space can flow through said excess flow valve into said upper vapor space when said lower liquid space reaches full fluid capacity, and wherein said excess flow rate is less than the input flow rate; and c) a fill tube having a distal end and a proximal end, the distal end extending through said partition and into said lower liquid space, the proximal end sealed to the fill valve, wherein liquefied gas flows through the fill valve and said fill tube into said lower liquid space until said lower liquid space reaches maximum liquid fluid capacity, at which time liquefied gas flows through said excess flow valve into said vapor space at said excess flow rate thereby causing a back pressure indicating that said lower liquid space is at maximum fluid capacity.

6. The device of claim 5, wherein said partition is positioned within the chamber of the tank body such that said liquid space occupies approximately eighty percent of the liquid capacity of the chamber.

7. The device of claim 5, wherein gas through said excess flow valve provides a back pressure counter the gas input flow rate, the device further comprising stopping means carried by the liquefied gas tank for automatically stopping the flow of gas into the tank upon detection of the back pressure.

8. The device of claim 5, further comprising a pressure relief valve carried by said partition wherein said pressure relief valve is capable of relieving pressure from said lower liquid space into said upper vapor space.

* * * * *